US009883712B1

(12) United States Patent
Toro et al.

(10) Patent No.: US 9,883,712 B1
(45) Date of Patent: Feb. 6, 2018

(54) WATERPROOF FOOTWEAR COVER

(71) Applicants: Hector Del Toro, Tampa, FL (US); Yanet Miranda, Tampa, FL (US)

(72) Inventors: Hector Del Toro, Tampa, FL (US); Yanet Miranda, Tampa, FL (US)

( * ) Notice: Subject to any disclaimer, the term of this patent is extended or adjusted under 35 U.S.C. 154(b) by 100 days.

(21) Appl. No.: 14/842,136

(22) Filed: Sep. 1, 2015

(51) Int. Cl.
*A43B 3/16* (2006.01)
*A43B 3/24* (2006.01)
*A43B 11/00* (2006.01)

(52) U.S. Cl.
CPC ..... *A43B 3/16* (2013.01); *A43B 3/248* (2013.01); *A43B 11/00* (2013.01)

(58) Field of Classification Search
CPC .. A43B 3/16; A43B 3/166; A43B 3/18; A43B 3/248; A43B 11/00
USPC ..... 36/7.1 R, 7.3, 100
See application file for complete search history.

(56) References Cited

U.S. PATENT DOCUMENTS 2,465,911 A * 3/1949 Morgan ..... A43B 3/16 36/10
2,479,006 A * 8/1949 Garth ..... A43B 3/16 36/7.3
2,755,566 A * 7/1956 Harrison ..... A43B 11/00 36/1
3,417,408 A * 12/1968 Caggiano ..... A43B 3/24 2/239
3,564,335 A 2/1971 Siegel
4,021,941 A * 5/1977 Caggiano ..... A01M 29/34 36/10
4,392,311 A * 7/1983 Rudolf ..... A43B 3/16 36/50.1
4,598,485 A 7/1986 Joe
4,708,272 A * 11/1987 Guerra ..... A43B 11/00 2/239
4,967,491 A 11/1990 Plotkin
D343,043 S 1/1994 Campbell
5,630,308 A * 5/1997 Guckenberger ..... B23K 26/067 53/412
5,970,633 A 10/1999 Jones
5,983,526 A * 11/1999 Pawlik ..... A43B 3/18 36/51
7,331,159 B2 * 2/2008 Osgood ..... B65B 11/12 53/412
2007/0044343 A1 3/2007 Harris
(Continued)

FOREIGN PATENT DOCUMENTS

CN 204104968 U 1/2015

*Primary Examiner* — Sharon M Prange

(57) ABSTRACT

The waterproof footwear cover is a disposable accessory that is adapted to be positioned over an article of footwear. The waterproof footwear cover is made of a soft plastic material that is adapted to be positioned over a foot and leg and a respective article of footwear. The waterproof footwear cover features at least one perforated tab, which when pulled enables the waterproof footwear cover to fold open in order to remove the leg, foot, and respective article of footwear. The at least one perforated tab is positioned on a layer surface of the waterproof footwear cover, and is pulled upwardly along a line of perforations in order to enable the waterproof footwear cover to open up. The at least one perforated tab may be provided on side surfaces adjacent an ankle of the foot and leg, as well as at the toe portion of the waterproof footwear cover.

1 Claim, 4 Drawing Sheets

(56) References Cited

U.S. PATENT DOCUMENTS

| | | | | |
|---|---|---|---|---|
| 2008/0222914 | A1* | 9/2008 | Sherman | A43B 1/0072 36/7.1 R |
| 2009/0119946 | A1 | 5/2009 | Baker | |
| 2011/0016744 | A1 | 1/2011 | Chan | |
| 2013/0042501 | A1 | 2/2013 | Velazquez | |
| 2014/0137430 | A1 | 5/2014 | Cherosky | |

* cited by examiner

WATERPROOF FOOTWEAR COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of footwear, more specifically, an accessory that is adapted to be positioned over an article of footwear in order to cover and protect said article of footwear.

Shoes and footwear can be pricey. When wearing said footwear outside, the elements can ruin or destroy said footwear. This is especially true in rainy or muddy conditions.

What is needed and is covered via the device of the present application is a disposable boot that is adapted to be positioned over a leg, foot, and an article of footwear in order to protect and cover the article of footwear from the elements. Furthermore, what is needed and accomplished herein is a device that is easily installed, easily opened after use, and disposable.

SUMMARY OF INVENTION

The waterproof footwear cover is a disposable accessory that is adapted to be positioned over an article of footwear. The waterproof footwear cover is made of a soft plastic material that is adapted to be positioned over a foot and leg and a respective article of footwear. The waterproof footwear cover features at least one perforated tab, which when pulled enables the waterproof footwear cover to fold open in order to remove the leg, foot, and respective article of footwear. The at least one perforated tab is positioned on a layer surface of the waterproof footwear cover, and is pulled upwardly along a line of perforations in order to enable the waterproof footwear cover to open up. The at least one perforated tab may be provided on side surfaces adjacent an ankle of the foot and leg, as well as at the toe portion of the waterproof footwear cover.

It is an object of the invention to provide a device that is adapted to be positioned over a leg, foot, and an article of footwear in order to cover and protect the article of footwear from the elements.

It is a further object of the invention to provide a device that is easily installed, and is disposable after use.

These together with additional objects, features and advantages of the waterproof footwear cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the waterproof footwear cover in detail, it is to be understood that the waterproof footwear cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the waterproof footwear cover.

It is therefore important that the claims be regarded as including such equivalent construction insofar as they do not depart from the spirit and scope of the waterproof footwear cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
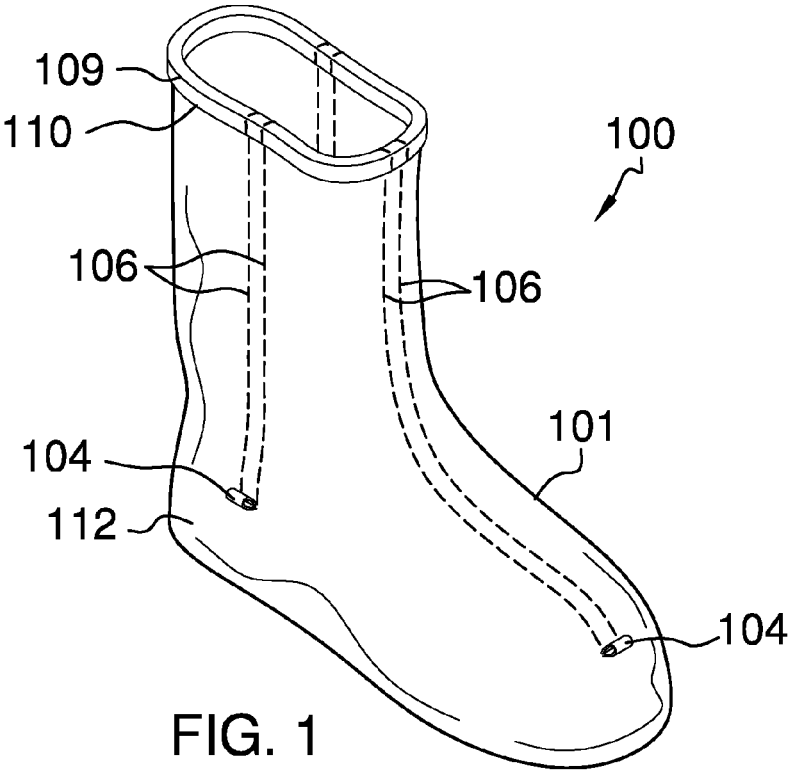
FIG. 1 is a front view of an embodiment of the disclosure.
Figure 2:
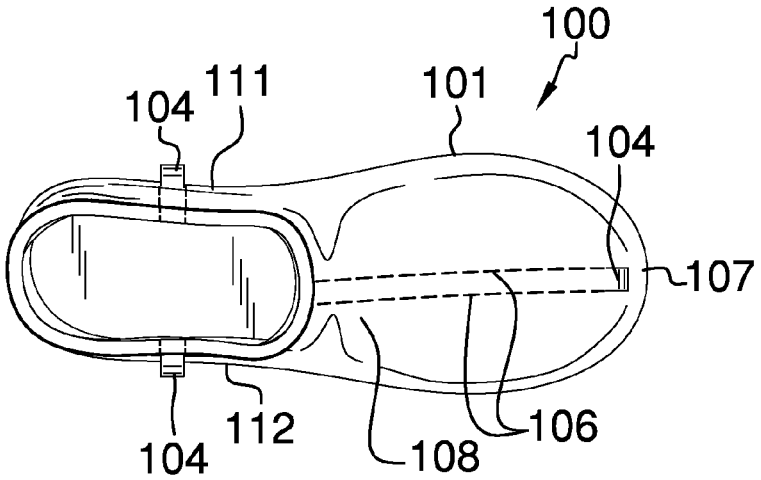
FIG. 2 is a top view of an embodiment of the disclosure.
Figure 3:
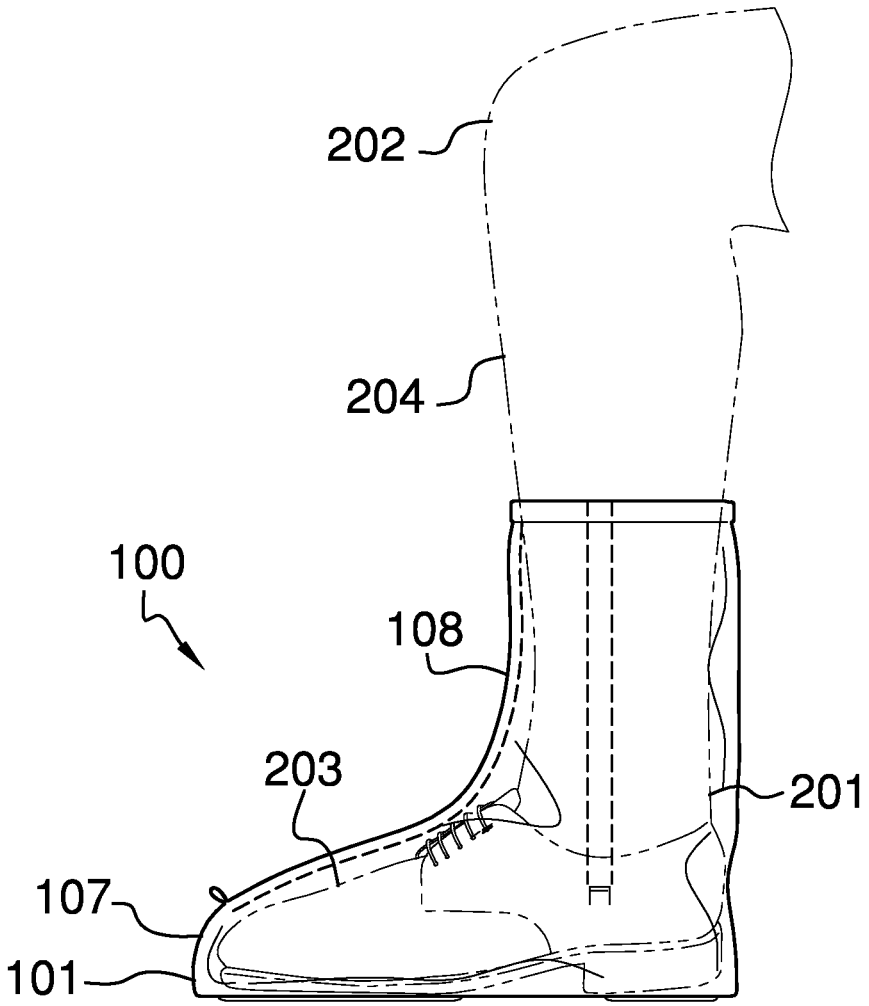
FIG. 3 is a side view of an embodiment of the disclosure.
Figure 4:
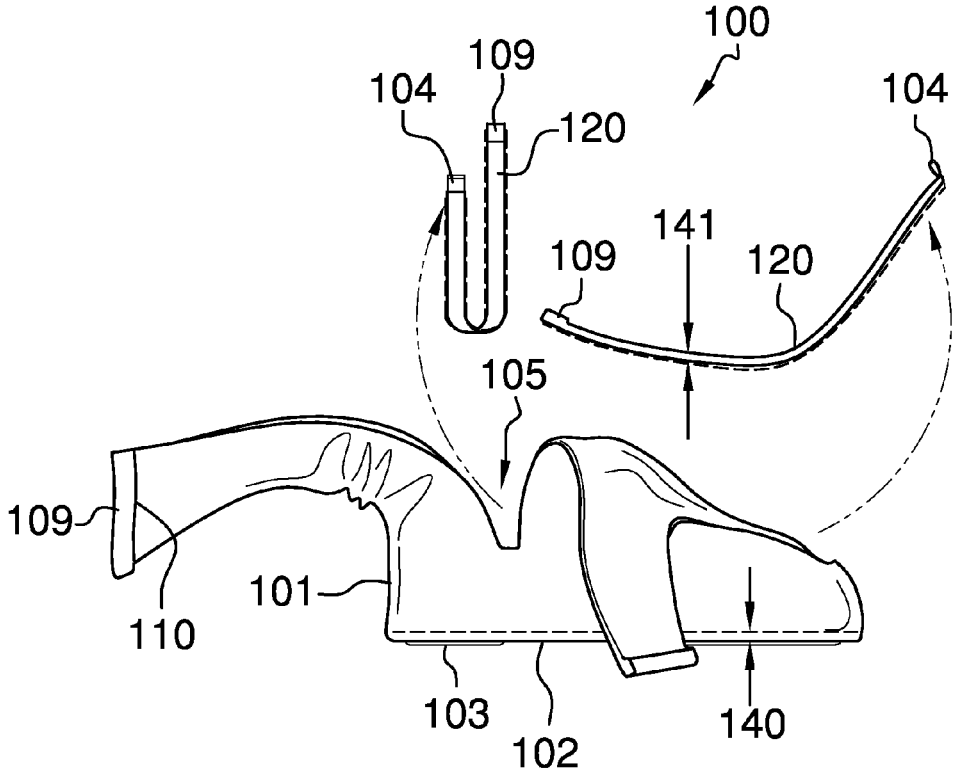
FIG. 4 is an open view of an embodiment of the disclosure.
Figure 5:
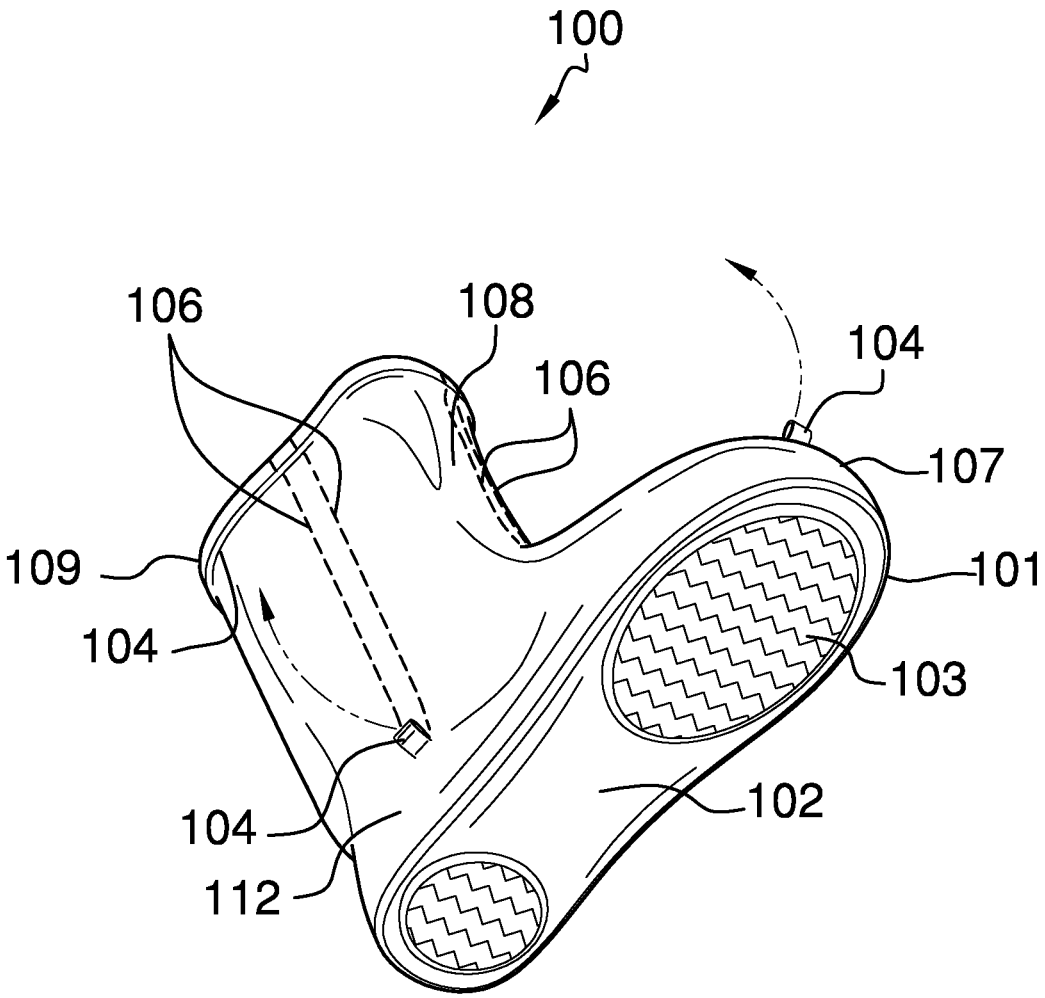
FIG. 5 is a bottom, perspective view of an embodiment of the disclosure.

Detailed reference will now be made to a first potential embodiment of the disclosure, which is illustrated in FIGS. 1 through 5. The waterproof footwear cover 100 (hereinafter invention) comprises a boot-shaped member 101 that is adapted to extend upwardly from an ankle 201. Moreover, the boot-shaped member 101 ideally extends upwardly to not more than a knee 202 of the user. The boot-shaped member 101 is made of a flexible, yet hydrophobic material, such as vinyl.

The boot-shaped member 101 is adapted to be positioned over an article of footwear 203 as well as a leg 204 of the user. The boot-shaped member 101 is further defined with a bottom surface 102 that is planar, and which includes at least one non-slip pad 103 thereon. The bottom surface 102 has a bottom thickness 140 that is sufficient to withstand use when walking on a ground surface. However, the remaining sides of the boot-shaped member 101 are defined with a side thickness 141. Moreover, the bottom thickness 140 is greater than or equal to the side thickness.

The boot-shaped member 101 includes at least one perforated tab 104 thereon. The at least one perforated tab 104 is positioned on a lower portion of the boot-shaped member 101. The at least one perforated tab 104 is designed to be pulled upwardly in order to form an opening 105 in the boot-shaped member 101 along a line of perforations 106.

The at least one perforated tab 104 may be provided on a toe portion 107 of the boot-shaped member 101. Moreover, the at least one perforated tab 104 is pulled along the line of perforations 106 extending along a front surface 108 of the boot-shaped member 101, and up to an elastic cuff 109 provided at a top edge 110 of the boot-shaped member 101. The elastic cuff 109 extends along a perimeter of the top edge 110.

Alternatively, the at least one perforated tab 104 may be provided on an inner, side surface 111 of the boot-shaped member 101. The line of perforations 106 extends upwardly from the inner, side surface 111 up to the elastic cuff 109. It shall be noted that the line of perforations 106 may be referred to as at least one line of perforations 106 or a pair of line of perforations 106. Moreover, the pair of line of perforations 106 are generally parallel with one another.

Alternatively, the at least one perforated tab 104 may be provided on an outer, side surface 112 of the boot-shaped member 101. The line of perforations 106 extends upwardly from the outer, side surface 112 up to the elastic cuff 109.

In use, the boot-shaped member 101 is positioned over the article of footwear 203. After use, the at least one perforated tab 104 is pulled along the line of perforations 106 in order to form the opening 105 required in order to extract the article of footwear 203. Afterwards, the at least one perforated 104 and an attached tab strip 120 are discarded along with the boot-shaped member 101.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A waterproof footwear cover comprising: a boot-shaped member that is adapted to be positioned over an article of footwear and a portion of a leg of a user; wherein the boot-shaped member is adapted to protect the article of footwear from the elements;

wherein the boot-shaped member is opened by forming an opening in order to extract the article of footwear after use, and the boot-shaped member is discarded thereafter;

wherein the boot-shaped member is adapted to extend upwardly from an ankle of the leg;

wherein the boot-shaped member is adapted to extend upwardly to not more than a knee of said leg;

wherein the boot-shaped member is made of a flexible, yet hydrophobic material; wherein the boot-shaped member is made of a vinyl;

wherein the boot-shaped member is further defined with a bottom surface that is planar; wherein the bottom surface includes at least one non-slip pad thereon;

wherein the bottom surface is further defined with a bottom thickness;

wherein the remaining sides of the boot-shaped member are defined with a side thickness;

wherein the bottom thickness is greater than or equal to the side thickness;

wherein the boot-shaped member includes a plurality of perforated tabs;

wherein the plurality of perforated tabs is positioned on a lower portion of the boot-shaped member;

wherein each of the plurality of perforated tabs is pulled upwardly in order to form said opening in the boot-shaped member along pairs of lines of perforations;

wherein a first perforated tab of the plurality of perforated tabs is provided on a toe portion of the boot-shaped member;

wherein the first perforated tab is pulled along a first pair of lines of perforations extending along a front surface of the boot-shaped member, and up to an elastic cuff provided at a top edge of the boot-shaped member;

wherein the elastic cuff extends along a perimeter of the top edge;

wherein a second perforated tab of the plurality of perforated tabs is provided on an inner, side surface of the boot-shaped member;

wherein a second pair of lines of perforations extends upwardly from the inner, side surface up to the elastic cuff;

wherein a third perforated tab of the plurality of perforated tabs is provided on an outer, side surface of the boot-shaped member;

wherein a third pair of lines of perforations extends upwardly from the outer, side surface up to the elastic cuff;

wherein the pairs of lines of perforations are generally parallel with one another;

wherein the plurality of perforated tabs is pulled along the pairs of lines of perforations in order to form the opening required in order to extract the article of footwear;

wherein the plurality of perforated tabs and attached tab strips formed via the pairs of line of perforations are discarded along with the boot-shaped member.

* * * * *